United States Patent [19]

Östholm

[11] Patent Number: 4,785,757

[45] Date of Patent: Nov. 22, 1988

[54] APPARATUS FOR BOAT SAILS

[76] Inventor: Ulf B. Östholm, Hildurs väg 26, S-198 00 Bålsta, Sweden

[21] Appl. No.: 22,806

[22] PCT Filed: May 15, 1986

[86] PCT No.: PCT/SE86/00229

§ 371 Date: Dec. 30, 1986

§ 102(e) Date: Dec. 30, 1986

[87] PCT Pub. No.: WO86/06697

PCT Pub. Date: Nov. 20, 1986

[30] Foreign Application Priority Data

May 17, 1985 [SE] Sweden ..... 8502452-9

[51] Int. Cl.[4] ..... B63H 9/08; B63H 9/04

[52] U.S. Cl. ..... 114/102; 114/103

[58] Field of Search ..... 114/39.1, 102–109; 244/219 A

[56] References Cited

U.S. PATENT DOCUMENTS

| | | | |
|---|---|---|---|
| 3,298,346 | 1/1967 | Cochran | 114/39 |
| 3,391,668 | 7/1968 | Birchill | 114/102 |
| 4,593,638 | 6/1986 | Cochran et al. | 114/103 |
| 4,633,798 | 1/1987 | Skinner et al. | 114/107 |

FOREIGN PATENT DOCUMENTS

| | | | |
|---|---|---|---|
| 445639 | 6/1927 | Fed. Rep. of Germany . | |
| 2240144 | 4/1975 | France | 114/103 |
| 2314863 | 1/1977 | France | 114/102 |
| 1153056 | 5/1969 | United Kingdom | 114/102 |

*Primary Examiner*—Joseph F. Peters, Jr.
*Assistant Examiner*—Edwin L. Swinehart
*Attorney, Agent, or Firm*—Paul & Paul

[57] ABSTRACT

An apparatus for stretching the sails of a boat comprises at least one elongate, fluid-tight container (6; 16) mounted on the sail (2; 3), the holder being connected to a pump (10) for inflating the container into a substantially stiff shape.

5 Claims, 1 Drawing Sheet

APPARATUS FOR BOAT SAILS

TECHNICAL FIELD

The present invention relates to apparatus for stretching boat sails.

BACKGROUND ART

For stretching boat sails, particularly the leech of a mainsail, it is customary to use battens of wooden or plastic slats insertable in pockets in the sail. Both insertion and removal of the battens is time-consuming. Furthermore, it may happen that a hoisted sail must be reefed to provide it with battens which have not been fitted due to carelessness. The battens may also get lost when they are not in use, and sometimes get lost even during use. If the sail provided with the battens is rigged on a boat having a mast and sail implemented such that the sail can be rolled into or round the mast when it is reefed, it is necessary to climb up the mast to remove or fit the battens before rolling in or rolling out the sail.

DISCLOSURE OF INVENTION

One object of the present invention is to remove the disadvantages with the battens described above and to provide an apparatus which requires minimum labour input by the user and enables optimum stretching of the sail in different conditions.

This object is achieved by the apparatus in accordance with the invention being given the distinguishing features disclosed in the characterizing portions of the claims.

PREFERRED EMBODIMENT

Figure 1:
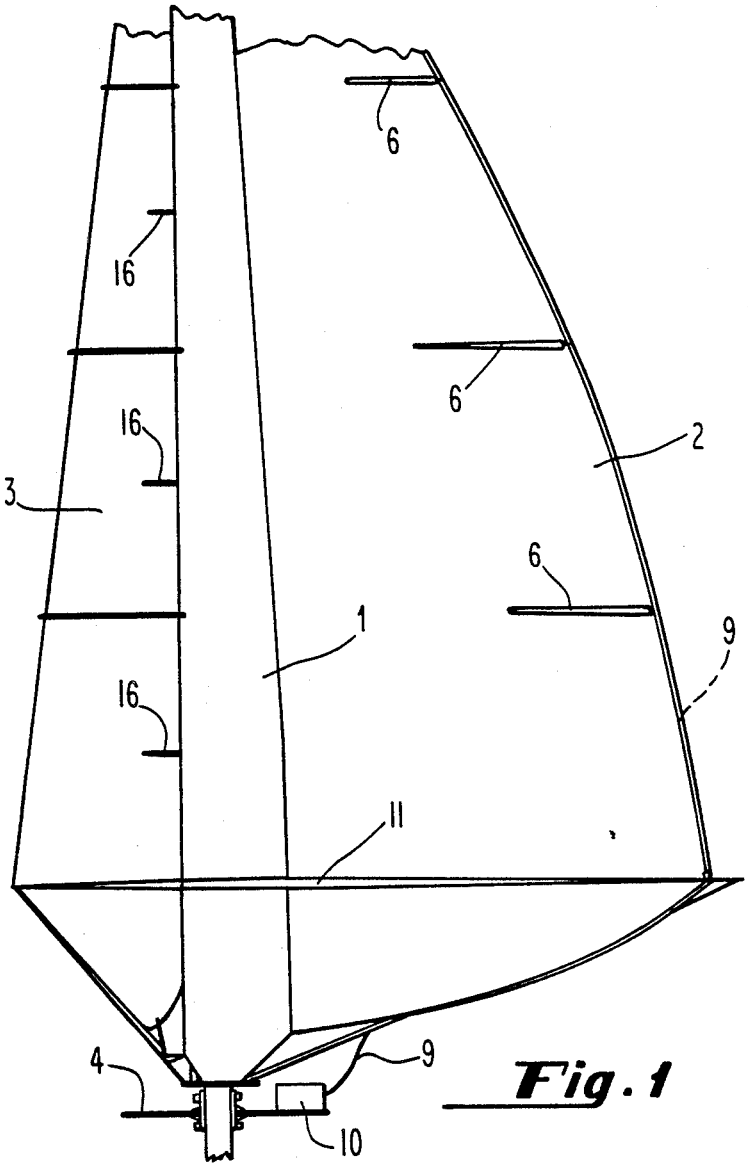
FIG. 1 is a schematic side view of the mast and sails on a sailing boat where both jib and mainsail are provided with apparatus in accordance with the invention.

In FIG. 1 there are illustrated part of a mast 1, parts of a mainsail 2, and a jib 3 and a boom 11 on a sailing boat, the deck of which is denoted by 4. The mast 1 is hollow and provided with unillustrated means for the rolling in and rolling out of at least the mainsail 2.

Figure 2:
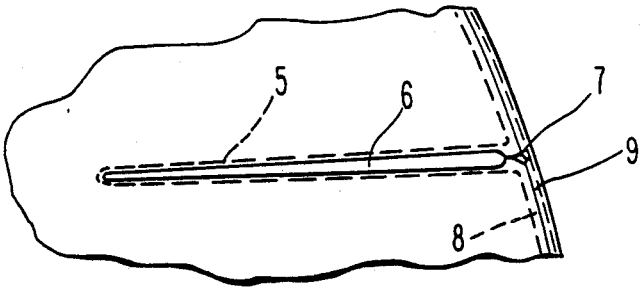
FIG. 2 is a view to a larger scale of the inventive apparatus illustrated in FIG. 1.

For stiffening and stretching the leech of the mainsail 2, containers 6 have been inserted into and preferably attached to sewn pockets 5, (see FIG. 2), each of these containers consisting of an airtight, suitably non-stretching but flexible material, such as rubberised fabric. The container 6 has an elongate, somewhat tapering shape with an oval or circular cross section. At the end having the greater cross section each container set has a nipple 7, which is connected to a hose 9, extending between the containers and inserted in a hem 8 along the leech of the mainsail 2. The hose 9 consists of a flexible, non-stretch material, and is connected at its lower end to an air pump 10, suitably placed on the deck 4 at the mast foot, the pump being operable either manually or by a suitable motor. By regulating the air pressure in the containers 6, optionally with the aid of a pressure gauge mounted on the pump 10, there is achieved that the containers are given a stiffness suited to prevailing sailing conditions.

The length, cross section, number and spacing of the containers 6 may be varied within wide limits to obtain optimum results. Relatively short containers 16, otherwise having the same structure and properties as the containers 6 can also be mounted on the jib 3 in the way illustrated in FIG. 1. The container 16 can be connected to an unillustrated hose, corresponding to the hose 9 and connected to the pump 10.

Before the sails 2 and 3 are reefed, the holders 6 and 16 are deflated by actuating the pump 10, or removing the hoses to them, subsequent to which the entire mainsail 2, and possibly the jib 3 as well, can be rolled into or round the mast 1, without obstruction.

Although only one embodiment of the invention has been shown on the drawing, and described above, it will be understood that the invention is not limited to this embodiment but only by the disclosures in the claims.

I claim:

1. Apparatus for stretching the leech of a sail which may be rolled into or round the mast of a boat, characterized in that the apparatus comprises a plurality of separate, elongate, fluid-tight containers (6;16), inserted in mutually spaced pockets (5) made at vertical spacings in the sail (2;3), said containers extending substantially horizontally from the leech of the sail to a place at a distance from the luff of the sail, the edges of the containers situated in the vicinity of the leech of the sail being connected to a pump (10) common to all of said containers for inflating said containers into a substantially stiff shape, and said containers being connected to each other and the pump (10) by a hose (9) running along the leech of the sail (2) and affixed thereto.

2. The apparatus of claim 1, wherein the containers (6;16) are connected to the hose (9) via nipples (7) mounted on the containers and situated in the vicinity of the leech of the sail (2;3).

3. The apparatus of claims 1 or 2, wherein the (10) is an air pump, and is suitably placed on the deck of the boat.

4. The apparatus of claim 1, or 2, wherein each pocket (5) is formed by sewing.

5. The apparatus of claim 1, or 2, wherein each container (6;16) comprises a fabric-reinforced rubber or plastic balloon.

* * * * *

UNITED STATES PATENT AND TRADEMARK OFFICE

CERTIFICATE OF CORRECTION

PATENT NO. : 4,785,757

DATED : November 22, 1988

INVENTOR(S) : Ulf B. Ostholm

It is certified that error appears in the above-identified patent and that said Letters Patent is hereby corrected as shown below:

Claim 3, line 1, before "(10)" insert --pump--.

Signed and Sealed this

Sixteenth Day of May, 1989

*Attest:*

*Attesting Officer*

DONALD J. QUIGG

*Commissioner of Patents and Trademarks*